US008443550B1

(12) United States Patent
Burns

(10) Patent No.: US 8,443,550 B1
(45) Date of Patent: May 21, 2013

(54) WINDOW GUARD

(75) Inventor: Les Burns, Mentone, CA (US)

(73) Assignee: Prime-Line Products Company, Inc., Redlands, CA (US)

( * ) Notice: Subject to any disclaimer, the term of this patent is extended or adjusted under 35 U.S.C. 154(b) by 175 days.

(21) Appl. No.: 13/066,326

(22) Filed: Apr. 12, 2011

(51) Int. Cl.
*E06B 3/50* (2006.01)
*E05D 15/56* (2006.01)

(52) U.S. Cl.
USPC ..... 49/141; 49/55; 49/57

(58) Field of Classification Search
USPC ..... 49/50, 55, 57, 463, 141
See application file for complete search history.

(56) References Cited

U.S. PATENT DOCUMENTS

| | | | | | |
|---|---|---|---|---|---|
| 533,937 | A | * | 2/1895 | Wiedinger | 52/37 |
| 935,673 | A | * | 10/1909 | Miller | 49/55 |
| 953,197 | A | * | 3/1910 | Drinkwater | 49/57 |
| 958,481 | A | * | 5/1910 | Drinkwater | 160/104 |
| 1,123,930 | A | * | 1/1915 | Ryan | 160/105 |
| 1,481,615 | A | * | 1/1924 | Meyer | 160/327 |
| 1,662,117 | A | * | 3/1928 | Kuhl | 49/57 |
| 1,662,167 | A | * | 3/1928 | Rexinger | 160/224 |
| 1,734,415 | A | * | 11/1929 | Bierfield | 160/105 |
| 1,984,001 | A | | 1/1934 | Tanzer et al. | |
| 2,262,800 | A | * | 11/1941 | Farmer | 160/223 |
| 2,589,878 | A | * | 3/1952 | Shapiro | 292/60 |
| 2,755,525 | A | * | 7/1956 | Minot, Jr. | 49/55 |
| 2,756,469 | A | * | 7/1956 | Cattermole et al. | 49/55 |
| 2,829,712 | A | * | 4/1958 | Quinn | 160/102 |
| 3,253,296 | A | | 5/1966 | Brown | |
| 3,336,060 | A | * | 8/1967 | Bradford | 403/108 |
| 3,705,468 | A | | 12/1972 | Ashworth | |
| 3,870,362 | A | | 3/1975 | Large | |
| 4,111,477 | A | | 9/1978 | Rigali | |
| 4,258,504 | A | * | 3/1981 | Hicks | 49/56 |
| 4,395,861 | A | * | 8/1983 | Fipke et al. | 52/833 |
| 4,437,265 | A | | 3/1984 | Turro et al. | |
| 4,671,012 | A | * | 6/1987 | Merklinger et al. | 49/55 |
| 4,756,122 | A | * | 7/1988 | Snapka | 49/57 |
| 4,796,384 | A | | 1/1989 | Warwick | |
| 4,817,334 | A | | 4/1989 | Badger et al. | |
| 4,837,974 | A | * | 6/1989 | Jokel | 49/55 |
| 4,884,369 | A | * | 12/1989 | Tatham | 49/404 |
| 4,899,490 | A | * | 2/1990 | Jokel | 49/55 |
| 4,939,866 | A | * | 7/1990 | Kluge | 49/55 |
| 5,070,647 | A | * | 12/1991 | Spialter | 49/55 |
| 5,207,022 | A | * | 5/1993 | Watt | 49/50 |
| 5,241,789 | A | * | 9/1993 | Vacelet | 49/248 |
| 5,454,415 | A | * | 10/1995 | Bolling et al. | 160/105 |
| 5,492,164 | A | | 2/1996 | Gist | |
| 5,628,355 | A | | 5/1997 | Gist | |
| 5,683,200 | A | | 11/1997 | Levy | |
| 5,910,076 | A | | 6/1999 | Gladney | |
| 5,916,074 | A | | 6/1999 | Tracy | |
| 6,141,912 | A | | 11/2000 | Graham et al. | |
| 6,216,391 | B1 | | 4/2001 | Garrett | |
| 6,296,041 | B1 | * | 10/2001 | Cicero | 160/327 |
| 2007/0056222 | A1 | | 3/2007 | Buchanan | |
| 2009/0277092 | A1 | | 11/2009 | Dochtermann, III | |

FOREIGN PATENT DOCUMENTS

| | | | |
|---|---|---|---|
| GB | 2030209 | A * | 4/1980 |
| GB | 2276901 | A * | 10/1994 |

* cited by examiner

*Primary Examiner* — Jerry Redman
(74) *Attorney, Agent, or Firm* — James A. Quinton

(57) ABSTRACT

According to the invention, a window guard having telescoping horizontal bars that have a predetermined minimum overlap of the telescoping bars which cannot be easily overridden by the window guard installer is provided. Such a device can reliably withstand a predetermined pressure when the window guard is extended to its maximum width.

21 Claims, 5 Drawing Sheets

WINDOW GUARD

FIELD OF THE INVENTION

The field of the invention is window guards to prevent pets or small children from falling from windows.

BACKGROUND OF THE INVENTION

Window guards made of interlocked metal bars are often installed in the bottom of windows in order to prevent small children or pets from falling from the window. Typically, window guards are designed and tested to withstand about 150 pounds of pressure. Window guards are usually recommended for installation in windows located on the second story and above of a building. See U.S. Pat. No. 6,141,912 (Graham). Security bars are also know in the art. Such bars deter entry from the outside by burglars. See: U.S. Pat. No. 4,817,324 (Badger); and US Pat Pub. 2009/0277092 (Dochtermann).

Government agencies often recommend the use of operable window guards, in particular, window guards with a release feature which allow them to be released and removed from the inside without the use of separate tools, keys, or excessive force, so as to permit escape in the event of an emergency. When telescoping bars are used, there are often local regulations on the amount the telescoping bars can be extended. There is a concern that the guard provides a strong deterrent to children and pets from falling through the window guard and out the window. For example one locality requires that when a window guard is used with telescoping bars extended to the maximum allowable width, there is a minimum overlap of five (5) inches or ⅓ of the length of the bar, which ever is greater.

SUMMARY OF THE INVENTION

According to the invention, a window guard having telescoping horizontal bars that have a predetermined minimum overlap of the telescoping bars which cannot be easily overridden by the window guard installer is provided. Such a device can reliably withstand a predetermined pressure when the window guard is extended to its maximum width.

According to the invention the window guard has a first plurality of spaced horizontal bars which are connected to a first vertical column. Desirably the horizontal bars are welded to a side of the first vertical column. The first vertical column is at least partially hollow through a part of its vertical length preferably hollow through its entire length. The first plurality of hollow horizontal bars are open at the end opposite the first vertical column.

The window guard includes a second plurality of spaced horizontal bars connected to a second vertical column. Desirably the horizontal bars are welded to a side of the second vertical column.

The second plurality of horizontal bars slide into the first plurality of horizontal bars to form a telescoping bar assembly so that the distance between the columns can be adjusted. As a result, the first and second plurality of horizontal bars are partially overlapping.

A cable extends through at least one bar (first preselected bar) of the first plurality of spaced hollow horizontal bars. This bar has an opening abutting the first vertical column. The cable is secured either directly or indirectly to the bar of the second plurality of spaced horizontal bars which slides into the first preselected bar at one end of the cable. The first vertical column has an first opening for the passage of the cable. The opening adjoins, that is touches, the cable containing bar. The opening in the first vertical column abuts the opening in the bar to provide communication between the interior of the cable containing bar and the space in the first vertical column. The cable extends through the opening in the first vertical column. The cable has a stop attached to the end extending through the first vertical column. Since the stop is larger than the opening in the first vertical column, the cable cannot be removed from the interior of the first vertical column. The length of the cable and the position of the stop set a minimum overlap of the first and second plurality of horizontal bars at a preselected amount. The stop is attached after the cable has been extended through the opening in the first vertical column.

In another aspect of the invention, the bar of the second plurality of spaced horizontal bars which slides into the cable containing bar of the first plurality of horizontal bars has a passageway through its length or is hollow. This bar is referred to as the second preselected bar. The second plurality of spaced horizontal bars are connected to a second vertical column. In this embodiment, the second vertical column is at least partially hollow through a part of its vertical length preferably hollow through its entire length. The second preselected bar has an opening at both ends. The second plurality of horizontal bars slide into the first plurality of horizontal bars to form a telescoping bar assembly so that the distance between the columns can be adjusted. The first and second plurality of horizontal bars are at least partially overlapping. A cable preferably metal cable extends through both the first and second preselected bars. Thus at least one pair of telescoped bars has a cable extending therethrough.

The first and second vertical columns have openings for the passage of the cable. These openings are aligned with the cable containing horizontal telescoped bars. The cable extends through the openings in the first and second vertical columns. The cable has a stop attached to each end. The stops are attached after the cable has been extended through the openings. The stops prevent the passage of the ends of the cable through the opening once the stop has been attached to said cable. The stops limit the passage of the cable through the openings in the vertical columns to control the minimum overlap of the first and said second horizontal bars.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
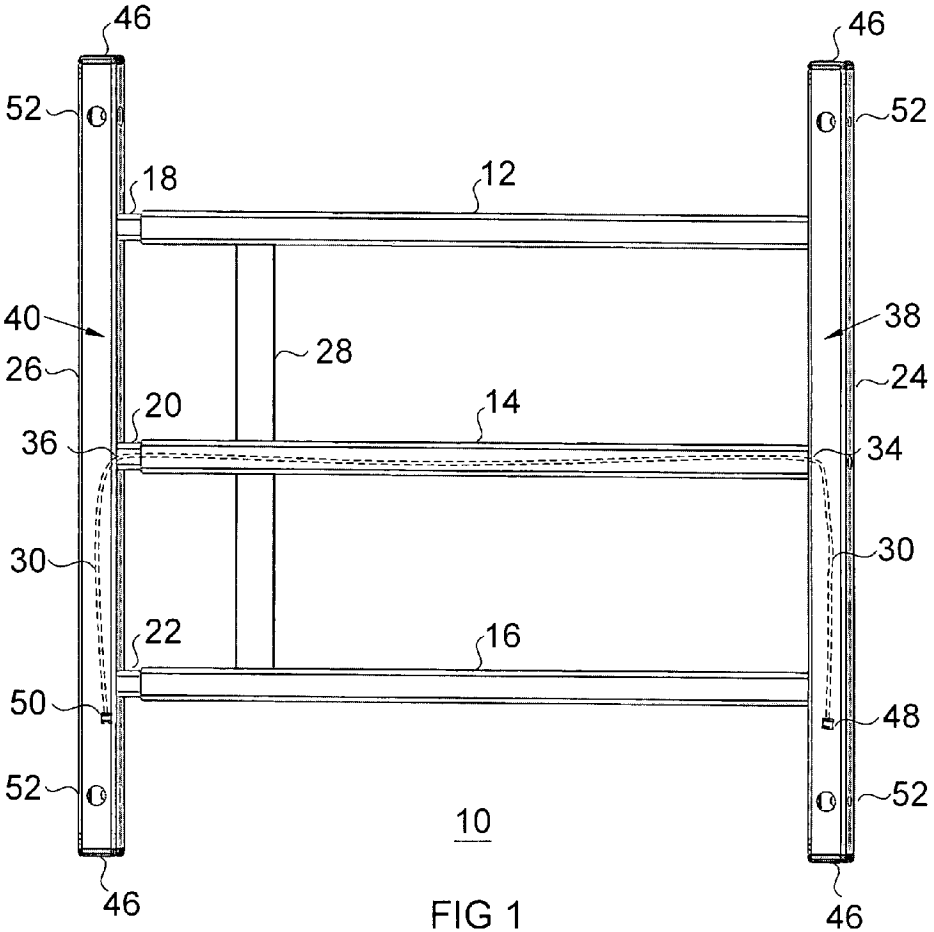
FIG. 1 is a front view of a window guard according to the invention.

According to the invention, a window guard having telescoping horizontal bars preferably metal desirably steel is provided. On installation, the telescoping bars have a predetermined minimum overlap desirably one-quarter to one-half the length of the bars preferably about one-third of the length of the bars which cannot be overridden by the window guard installer. Such a device can reliably withstand a predetermined pressure desirably 150 lbs. or greater even when the window guard is extended to its maximum width.

According to the invention the window guard has a first plurality of spaced horizontal bars preferably metal desirably steel which are connected to a first vertical column. Desirably the horizontal bars are welded to a side of the vertical column.

The first vertical column is at least partially hollow through a part of its vertical length preferably hollow through its entire length. The first plurality of hollow horizontal bars are open at the end opposite the first vertical column. Desirably the first vertical column is a hollow square bar preferably a metal square bar desirably steel.

The window guard includes a second plurality of spaced horizontal bars desirably steel preferably hollow metal bars optionally solid steel bar connected to a second vertical column preferably a steel column. Desirably the horizontal bars are welded to a side of the second vertical column. Desirably the vertical column is a square bar preferably a metal square bar desirably carbon steel that can be solid or hollow.

The second plurality of horizontal bars slide into the first plurality of hollow horizontal bars to form a telescoping bar assembly so that the distance between the columns can be adjusted. As a result, the first and second plurality of horizontal bars are partially overlapping.

A cable preferably a metal cable desirably a 7×16 GAC galvanized wire rope extends through at least one bar of the first plurality of spaced hollow horizontal bars. This bar has an opening abutting the first vertical column. The cable is secured to the bar of the second plurality of spaced horizontal bars which slides into the preselected bar at one end of the cable. The first vertical column has a first opening for the passage of the cable. The opening adjoins the preselected bar. The opening in the first vertical column abuts the opening in the preselected bar to provide communication between the interior of the preselected bar and the hollow in the first vertical column. The cable extends through the opening in the first vertical column. The cable has a stop attached to the end extending through the first vertical column. Since the stop is larger than the opening in the first vertical column, the cable cannot be removed from the interior of the first vertical column. The length of the cable and the position of the stop set a minimum overlap of the first and said second plurality of horizontal bars at a preselected amount. Desirably the minimum overlap is set at one-quarter to one-half the length of a horizontal bar desirably one-third or greater desirably about one-third which cannot be overridden by the window guard installer. The stop is attached after the cable has been extended through the opening in the first vertical column. Optionally multiple bars of the telescoping assembly can contain metal cable. Corresponding openings in the vertical columns are then provided as described for one bar containing cable.

In another aspect of the invention, the window guard has a first plurality of spaced hollow horizontal bars desirably metal preferably steel connected to a first vertical column preferably a steel column, desirably a hollow square column preferably a metal square column desirably steel. Desirably the first plurality of spaced horizontal bars are welded to the first vertical column. Desirably three to five horizontal bars are provided. The first vertical column is at least partially hollow through a part of its vertical length preferably hollow its entire length. The plurality of first horizontal bars has openings on the end opposite to the end connected to the first vertical column. At least one of the first plurality of hollow horizontal bars has an opening adjacent the first vertical column.

The window guard according to the invention has a second plurality of spaced horizontal bars preferably hollow desirably metal preferably steel bars corresponding in number to the first plurality of spaced hollow horizontal bars. Desirably at least one of the second plurality of horizontal bars has a passageway through its length. The second plurality of horizontal bars are connected preferably welded to a second vertical column that is desirably metal preferably steel. The second vertical column is desirably at least partially hollow through a part of its vertical length. Preferably the second vertical column is hollow along its entire length. Preferably one of the second plurality of horizontal bars has an opening at both ends. Desirably all the second plurality of horizontal bars have an opening at both ends. The second plurality of horizontal bars slide into the first plurality of horizontal bars to form a telescoping bar assembly so that the distance between the columns can be adjusted. The first and second plurality of horizontal bars are overlapping a preselected amount. Desirably, there is a minimum overlap of five (5) inches or one-third ⅓ of the length of the bar, which ever is greater.

A cable preferably metal desirably a 7×16 GAC galvanized wire rope extends through at least one of the first plurality of horizontal bars and preferably through at least one of the second horizontal bars of the telescoping assembly. Thus desirably at least one pair of telescoped bars has a cable extending therethrough.

The first vertical column has a first opening for the passage of the cable. Desirably the second vertical column has a first opening for the passage of the cable. The openings are aligned with the horizontal telescoped bars containing cable. Desirably the first opening extends through the wall of the column adjacent the attached horizontal bars. Desirably a second larger opening is provided on the wall of the vertical column opposite to the wall to which the horizontal bar are attached as well. The second opening is aligned with the first opening. The cable extends through the openings in the first and desirably the second vertical columns adjacent the horizontal bar containing the cable. Preferably the cable is contained in the horizontal bar that is located nearest the mid-point of the vertical columns. The cable has a stop desirably an aluminum button attached to at least one end preferably to each end of the cable. Desirably the stop is substantially inaccessible during installation and use. Preferably the stop is recessed from the outside of the vertical column. Desirably the stop is closed off from the outside of the column so that the stop is substantially inaccessible from the outside. The stop is larger than the first opening adjacent the horizontal bars to stop the cable end from passing through and thereby limit the amount the horizontal bar can be moved apart. The stops are attached after the cable has been extended through the first and second openings. The first opening adjoining the horizontal bars is smaller than the opposite opening (second opening). The aluminum button (stop) can be forced through the second larger opening, but it is too large to pass through the first opening adjacent the horizontal bars. The stops prevent the passage of the ends of the cable through the first opening once the stop has been attached to the cable to limit the maximum distance between the columns. The stops limits the passage of the cable through the opening to control the minimum overlap of the first and the second plurality of horizontal bars. The length of the cable between the stops is selected to limit the telescoping of the bars to a preselected amount, desirably one-quarter to one-half preferably about one-third of the length of one of the horizontal bars which cannot be overridden by the window guard installer.

Desirably the second vertical column has holes at the top and bottom of the column. Desirably the holes are both perpendicular and parallel to the welded horizontal bars to allow the window guard to be attached either inside or outside a window frame.

Figure 2:
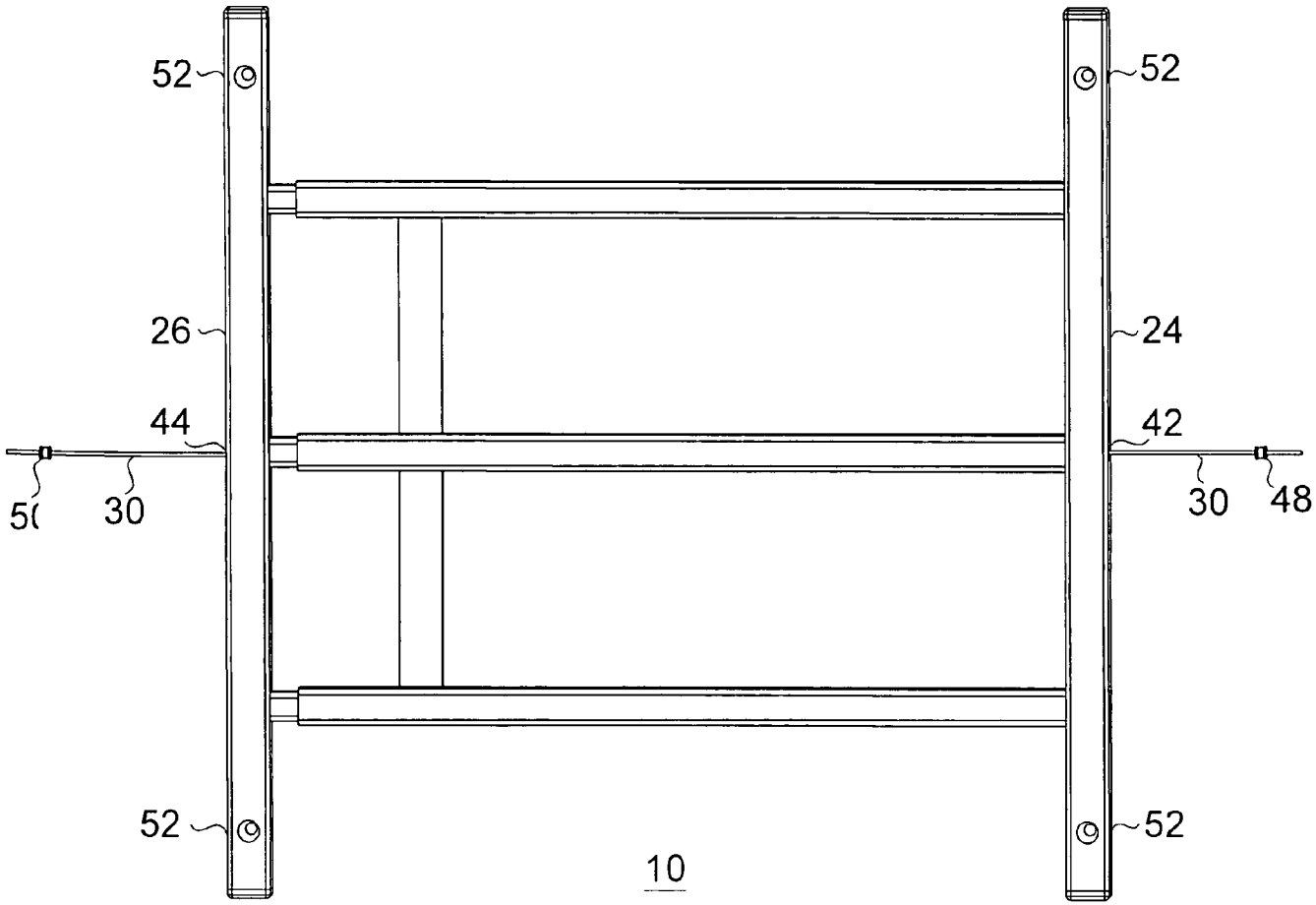
FIG. 2 is a front view of a window guard according to the invention during assembly.
Figure 3A:
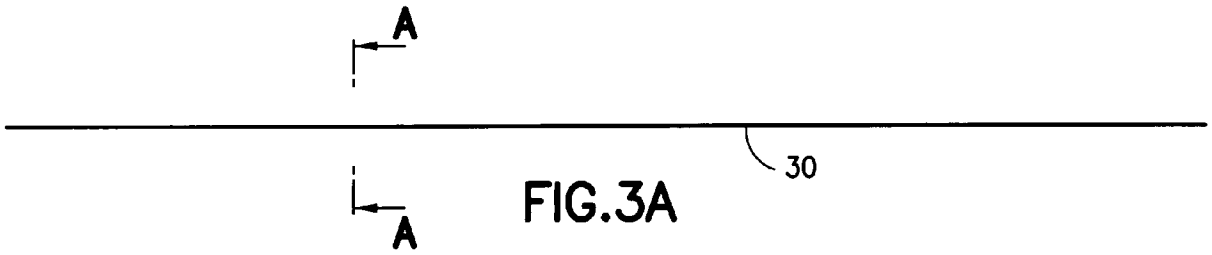
FIG. 3A is a side view of the cable according to the invention.
Figure 3B:
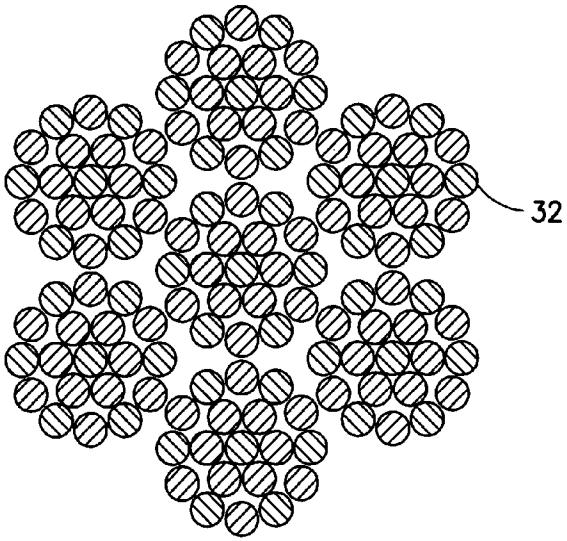
FIG. 3B is a sectional view through A-A of FIG. 3A.

As best seen in FIGS. 1 through 3, a window guard 10 according to the invention is provided. A first plurality of horizontal bars, desirably hollow steel bars 12, 14 and 16 is provided. The bars are spaced apart and extend horizontally across the window guard. The first plurality of horizontal bars 12, 14 and 16 are connected to a first vertical column 24, preferably by welding horizontal bars 12, 14 and 16 to the vertical column 24. Vertical column 24 is at least partially hollow through its length adjacent one of the horizontal bars preferably hollow adjacent middle bar 14. Vertical column 24 is preferably hollow through its in entire length and provides a space 38 within the column. Desirably, three(3) to five(5) horizontal bars preferably three(3) as shown in FIG. 1 are provided. Horizontal bars 12, 14 and 16 are hollow and have openings opposite to the ends that are welded to vertical column 24. At least one of the horizontal bars, desirably, the middle bar 14 has an opening at the end where it is connected to vertical column 24. According to the invention, a second plurality of spaced horizontal bars 18, and 22 are provided which have a diameter somewhat smaller than that of bars 12, 14 and 16. Bars 18, 20 and 22 are received by bars 12, 14 and 16 in a telescoping relationship to form a telescoped assembly. The second plurality of horizontal bars are connected, preferably welded, to second vertical column 26. Desirably, a second vertical column 26 is partially hollow, preferably hollow adjacent middle bar 20 preferably entirely hollow, to provide a space 40 in the interior of column 26. At least one of the second plurality of horizontal bars has a passage way through its entire length. Desirably, one bar is hollow through its entire length desirably middle bar 20. Preferably, all the horizontal bars 18, 20 and 22 are hollow through their entire length. The distance between the vertical columns 26 and 24 can be adjusted by telescoping of bars 18, 20, and 22 within the first plurality of bars 12, 14 and 16. Adjusting the overlap sets the distance between the first and second vertical columns 24 and 26. As best shown in FIG. 3, a cable desirably a metal cable, preferably a 7×16 GAC galvanized wire rope 30 extends through at least one of the telescoped pair of bars, preferably the middle bars 14 and 20. The desired distance between columns is set prior to mounting the columns to the window frame or wall. Vertical column 24 has an opening 34 for passage of the cable 30. Desirably, vertical column 26 also has an opening 36 for passage of the cable. Opening 34 and 36 are in alignment with the telescoped horizontal bars containing the cable that is middle bars 14 and 20. The cable 30 passes through the openings 34 and 36.

As best seen in FIG. 2, vertical column 24 preferably has a opening 42 on its outside wall which is in alignment with opening 36. Desirably, vertical column 26 also has an opening 44 on its outside wall. Openings 42 and 44 preferably are larger than openings 34 and 36. A stop, preferably aluminum stops 48 and 5*o* are provided at each end of cable 30. The stops 48 and 50 desirably fits through larger holes 44 and 42 but are too large to fit through holes 36 and 34 on the inside wall of the first and second vertical columns 24 and 26. In assembly, the stops 48 and 50 are crimped to the cable 30 after the cable has been threaded through holes 34, 42, 36 and 44. The stops will then be forced through the larger holes 44 and 42 and the cable will hang in the interior of vertical columns 24 and 26 substantially inaccessible from the outside. The stops 48 are too big to pass through holes 36 and 34. As a result, the amount of telescoping that can be achieved in widening the width of the window guard is restricted by the stops on cable 30. Desirably, cable and stops are sized so that it is a minimum overlap of 5 inches or ⅓ the length of the bars whichever is greater. Thus, the integrity of the window guard is protected against inadvertent over extension of the bars and thus, providing a weaker protection. The cable is a metal cable, preferably a 7×16 GAC galvanized wire rope which extends through the telescoped horizontal bars, preferably though at least one pair of the telescoped horizontal bars, preferably one near the middle of the window guard 10. Optionally one or more vertical supports 28 are provided for added strength. The resulting device when installed can withstand a pressure of 150 lbs. or greater even when the window guard is extended to its maximum width. Optionally, the second plurality of the bars can be solid bars with one of the bars, preferably the middle bar 20, having a passageway for the receipt of cable 30 instead of the hollow bars as shown in FIG. 1. Preferably, the stops 48 and 50 are aluminum buttons which have been crimped onto cable 30. Desirably, caps 46 are provided on the ends of vertical columns 24 and 26 to prevent access to the interior of the vertical columns 24 and 26. The stops 48 and 50 are recessed and substantially in accessible in the interior of the vertical columns 24 and 26 to make any overriding of the stops to extend the telescoped width difficult. In this regard caps 46 prevent access to the hollow interior of the bars. The length of the cable and the position on the stops are selected to limit the telescoping of the bars to a preselected amount. Desirably, the vertical columns 24 and 26 include mounting holes 52 for mounting the window guard to the window frame. In FIG. 1 the holes are shown for straight mounting into the wall. Optionally, the holes could be provided on the other sides of the columns for mounting to the window frame. As shown in FIG. 3, the cable is desirably a 7×16 GAC galvanized wire rope 30 which desirably extends to the length of the one telescoped pair of horizontal bars composed of one of the first and one of the second plurality of the horizontal bars, for example, 14 and 20.

Figure 4:
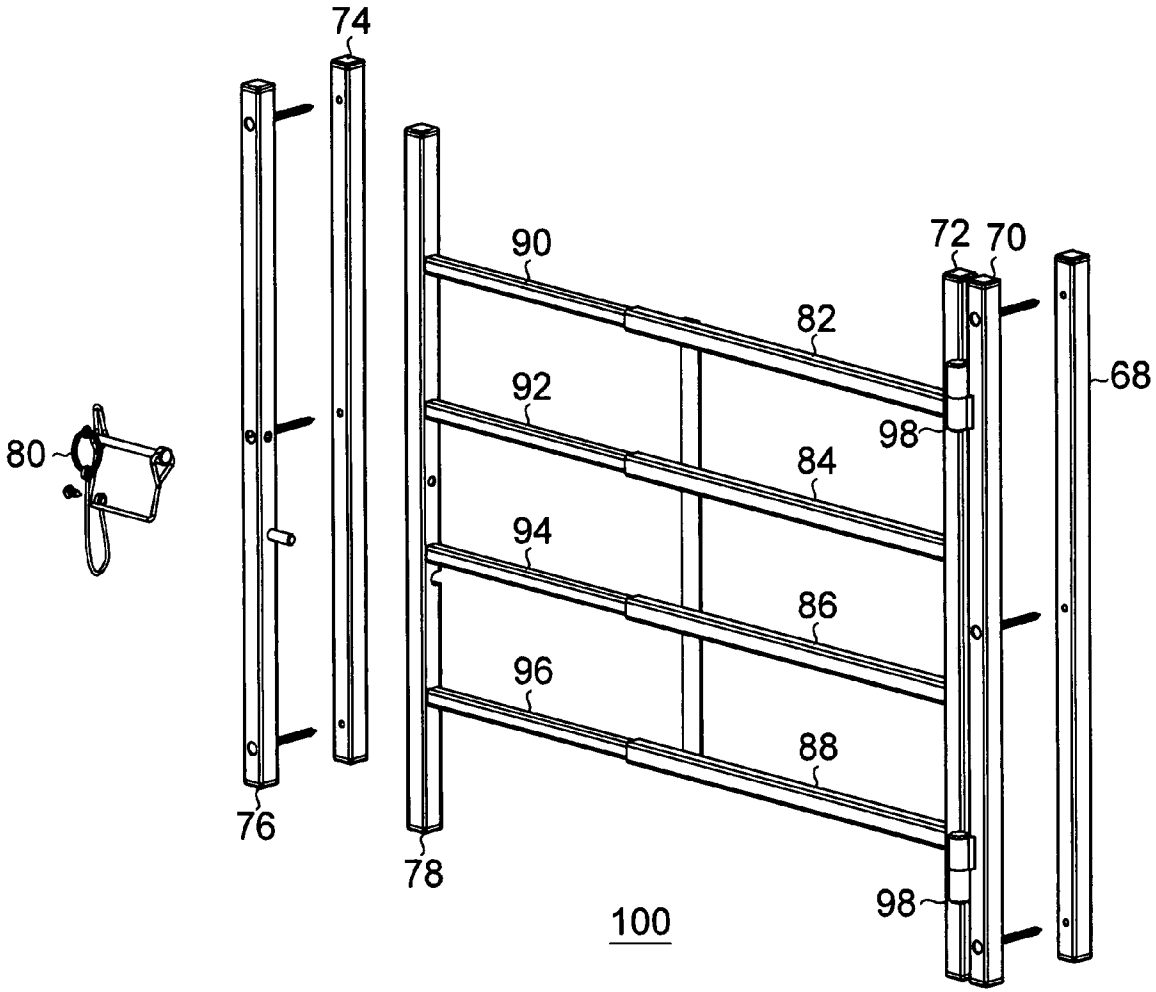
FIG. 4 is a front view of an alternative embodiment of the window guard according to the invention.

As best shown in shown in FIG. 4, an alternative embodiment 100 of the window guard according to the invention is provided which allows access to the window from the inside. Six vertical columns are desirably provided. In such an embodiment, a first vertical column 72 is provided with a plurality of hollow horizontal bars 82, 84, 86, 88 welded to column 72 as described with regard to FIG. 1. A further vertical column 70 is attached to column 72 by hinges 98. A cable having a stop is provided through one or more of the horizontal bars and the vertical column 72 as described in FIG. 1 is provided. Column 70 is mounted to the wall or window frame through a jack bar 68. On the opposite side of the window guard side, a second vertical column 78 is provided with a second plurality of hollow horizontal bars 90, 92, 94, 96 welded to column 78 as described with regard to FIG. 1. A further vertical column 76 is attached to column 78 by a releasable clip 80. A cable having a stop is provided through one or more of the horizontal bars and the vertical column 78 as described in FIG. 1 is provided. Column 76 is mounted to the wall or window frame through a jack bar 74. In operation, the release pin 8*o* is pulled out, which releases column 78 so window guard 100 swings outward on hinges 98.

Figure 5:
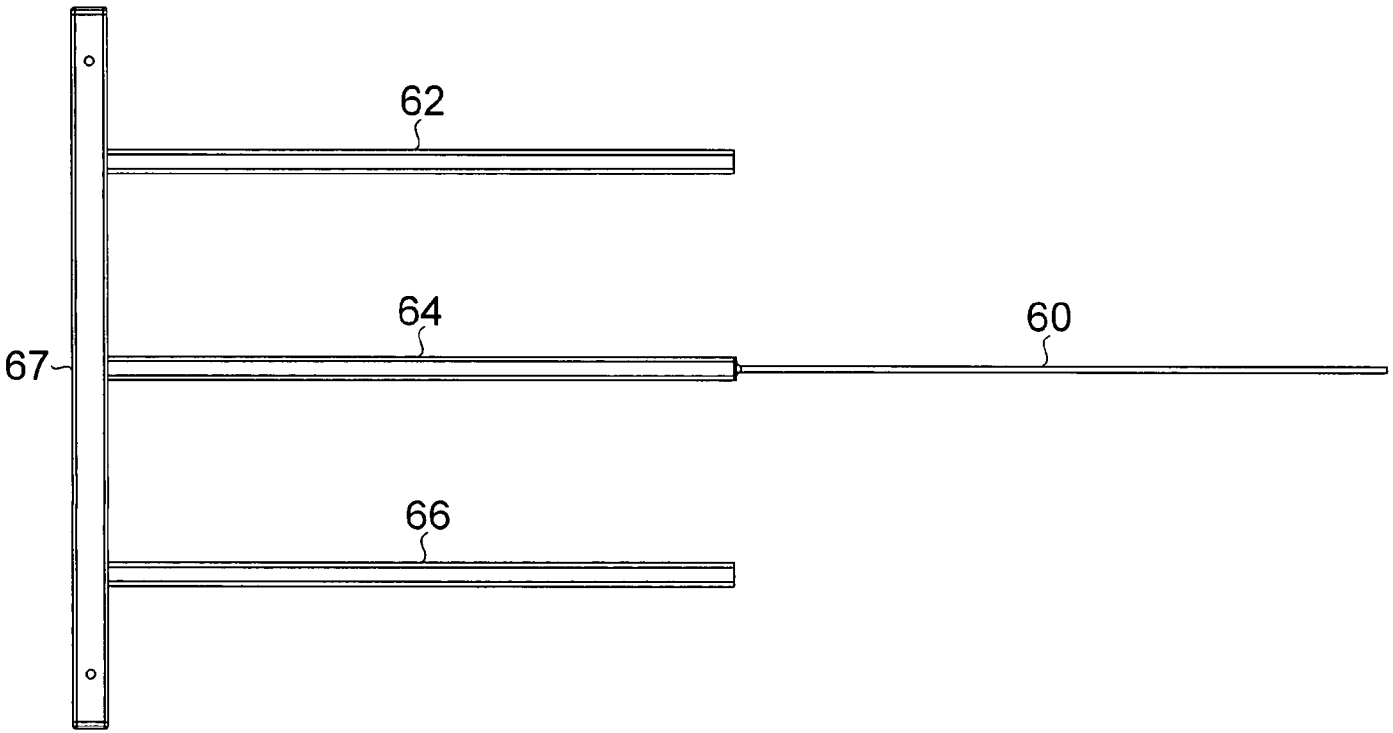
FIG. 5 is a front view of an alternative embodiment of the window guard according to the invention.

As best seen in FIG. 5, in another embodiment of the invention, at least one of the second plurality of horizontal bars 62, 64, or 66 is solid. A cable 6*o* is attached to the end of at least one of the solid bars of the second plurality of horizontal bars preferably middle bar 64 by welding or the like.

Thus, the cable 6*o* in this embodiment would not extend to the second vertical column 68. It would only extend through the first vertical column as shown in FIG. 1.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A window guard comprising:

a) a first plurality of spaced hollow horizontal bars connected at a first end to a first vertical column; said first vertical column at least partially hollow through a part of its vertical length; a first preselected bar of said first plurality of hollow horizontal bars having an opening at both ends;

b) a second plurality of spaced horizontal bars connected to a second vertical column; said second vertical column at least partially hollow through a part of its vertical length hollow;

c) a second preselected bar of said second plurality of horizontal bars having an opening at both ends and a passageway through its entire length; said first plurality of spaced horizontal bars having an opening at a second end opposed to said first end for receipt of said second plurality of horizontal bars;

d) said second plurality of horizontal bars slidably received in said first plurality of horizontal bars to form a telescoping bar assembly so that the distance between said vertical columns can be adjusted; said first and said second horizontal bars overlapping over a preselected range; said second preselected bar received by said first preselected bar;

e) a cable extending through said telescoping bar assembly by passing through said first preselected bar and said second preselected bar;

f) said first and second vertical columns having a first opening for the passage of said cable therethrough; said first openings in said columns abutting said first and second preselected bars containing said cable; said cable extending through said first openings in said first and second vertical columns;

g) said cable having a stop attached to each end after said cable has been extended through said first openings, said stop having a larger diameter than said first openings to prevent the passage of each of the ends of said cable through said first openings to limit the maximum distance between said columns and control the minimum overlap of said first and said second plurality of horizontal bars.

2. The window guard according to claim 1 wherein said second vertical column is at least partially hollow through a part of its vertical length.

3. The window guard according to claim 1 wherein said second vertical column is hollow.

4. The window guard according to claim 3 wherein said first vertical column is hollow.

5. The window guard according to claim 4 wherein said first and second vertical columns have a second opening opposed to said first opening for the passage of said cable therethrough; said second openings larger than and aligned with said first openings; said cable extending through said second openings in said first and second vertical columns during assembly of said window guard.

6. The window guard according to claim 5 wherein said stops have a smaller diameter than said second openings so said stops pass through said second openings.

7. The window guard according to claim 4 wherein said second preselected bar is hollow.

8. The window guard according to claim 4 wherein said second plurality of horizontal bars are hollow.

9. The window guard according to claim 1 wherein said stops are located at the ends of said cable; said stops recessed in the interior of said first and second vertical columns so that said stops are substantially inaccessible from the outside during installation of said window guard.

10. The window guard according to claim 1 wherein said stops are crimped to said cable.

11. The window guard according to claim 1 wherein said first and second plurality of horizontal bars have a top bar and a bottom bar and one or more middle bars; said first and second preselected bars being one of said middle bars.

12. The window guard according to claim 1 wherein said minimum over lap is one quarter to one half the length of said first preselected bar.

13. The window guard according to claim 1 wherein said minimum over lap is one third or greater the length of said first preselected bar.

14. The window guard according to claim 1 wherein said first and second vertical columns are closed off at the bottom.

15. The window guard according to claim 14 wherein said first and second vertical columns are closed off at the top.

16. A window guard comprising:

a) a first plurality of spaced hollow horizontal bars connected at a first end to a first vertical column; said first vertical column at least partially hollow through a part of its vertical length b) a second plurality of spaced horizontal bars connected to a second vertical column at a first end; said second plurality of bars having a second end opposed to said to said first end;

c) said first plurality of spaced horizontal bars having an opening at a second end opposed to said first end for receipt of said second plurality of horizontal bars; a first preselected bar of said first plurality of spaced hollow horizontal bars having an opening at said first end;

d) said second plurality of spaced horizontal bars slidably received at said second end in said first plurality of horizontal bars to form a telescoping bar assembly so that the distance between said columns can be adjusted; said first and said second plurality of horizontal bars at least partially overlapping;

e) a cable extending through said first preselected bar of said first plurality of spaced hollow horizontal bars; said cable having a first and second end; said cable secured at said second end to the second end of a second preselected bar of said second plurality of spaced horizontal bars said second preselected bar slidably received by said first preselected bar;

f) said first vertical column having a first opening for the passage of said cable first end therethrough; said first opening abutting said first preselected bar; said cable first end extending through said first opening in said first vertical columns;

g) said cable having a stop attached to said first end of said cable; said stop preventing the passage said cable through said first opening to provide a preselected minimum overlap of said first and said second plurality of horizontal bars.

17. The window guard according to claim 16 wherein said cable first end is secured to a second end of opposed to the first end of said bar of said second plurality of spaced horizontal bars slidably received by said preselected bar.

18. The window guard according to claim 17 wherein said cable second end is welded to said second end of said second preselected bar.

19. The window guard according to claim 16 wherein said first vertical column is hollow.

20. The window guard according to claim 16 wherein said first vertical column has a second opening opposite said first opening for the passage of said cable; said second opening larger than and aligned with said first opening; said stop passing through said second opening during assembly.

21. The window guard according to claim 16 wherein said first and second plurality of horizontal bars have a top bar and a bottom bar and one or more middle bars; said first and second preselected bars being one of said middle bars.

* * * * *